US008007904B2

(12) United States Patent
Dugan

(10) Patent No.: US 8,007,904 B2
(45) Date of Patent: Aug. 30, 2011

(54) METAL-COATED FIBER

(75) Inventor: Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 412 days.

(21) Appl. No.: 12/352,060

(22) Filed: Jan. 12, 2009

(65) Prior Publication Data

US 2009/0181592 A1 Jul. 16, 2009

Related U.S. Application Data

(60) Provisional application No. 61/020,449, filed on Jan. 11, 2008.

(51) Int. Cl.
*B32B 15/00* (2006.01)
*D02G 3/00* (2006.01)

(52) U.S. Cl. ..... 428/379; 428/221; 428/358; 428/361; 428/364; 428/365; 428/372; 428/373; 428/374; 428/375; 428/378; 428/393; 428/394; 428/395; 428/400; 442/199; 442/311; 442/335; 442/361; 442/362; 442/414

(58) Field of Classification Search ..... 442/199, 442/311, 335, 361, 362, 414; 428/221, 358, 428/361, 364, 365, 372–375, 378, 379, 393–395, 428/400

See application file for complete search history.

(56) References Cited

U.S. PATENT DOCUMENTS

| | | | |
|---|---|---|---|
| 2,150,349 | A | 3/1939 | Peski et al. |
| 3,314,931 | A | 4/1967 | Davis et al. |
| 3,967,010 | A | 6/1976 | Maekawa |
| 4,001,367 | A | 1/1977 | Guthrie et al. |
| 4,247,595 | A | 1/1981 | Nomura et al. |
| 4,347,203 | A | 8/1982 | Mimura et al. |
| 4,362,779 | A | 12/1982 | Arsac |
| 4,460,648 | A | 7/1984 | Kondo et al. |
| 4,744,906 | A | 5/1988 | Gerlach et al. |
| 4,869,930 | A | 9/1989 | Clarke et al. |
| 4,971,885 | A | 11/1990 | Hammann, IV et al. |
| 5,049,382 | A | 9/1991 | Price et al. |
| 5,057,368 | A | 10/1991 | Largman et al. |
| 5,069,970 | A | 12/1991 | Largman et al. |
| 5,094,670 | A | 3/1992 | Imada |
| 5,162,074 | A | 11/1992 | Hills |
| 5,258,129 | A | 11/1993 | Kato et al. |
| 5,277,976 | A | 1/1994 | Hogle et al. |
| 5,403,426 | A | 4/1995 | Johnson et al. |
| 5,683,610 | A | 11/1997 | Nohr et al. |
| 5,736,619 | A | 4/1998 | Kane et al. |
| 5,800,758 | A | 9/1998 | Topolkaraev et al. |
| 5,972,505 | A | 10/1999 | Phillips et al. |
| 6,037,057 | A | 3/2000 | Hartzog et al. |
| 6,110,588 | A | 8/2000 | Perez et al. |
| 6,287,542 | B1 | 9/2001 | Bernard et al. |
| 6,335,301 | B1 | 1/2002 | Kikuchi et al. |
| 6,359,079 | B1 | 3/2002 | Palmer, Jr. |
| 6,399,103 | B1 | 6/2002 | Yamagata et al. |
| 6,506,293 | B1 | 1/2003 | Rumpf |
| 6,726,964 | B1 | 4/2004 | Thompson et al. |
| 6,841,244 | B2 | 1/2005 | Foss et al. |
| 7,294,673 | B2 | 11/2007 | Kanazawa |

*Primary Examiner* — Norca L Torres-Velazquez
(74) *Attorney, Agent, or Firm* — Womble Carlyle Sandridge & Rice, PLLC

(57) ABSTRACT

A multicomponent fiber having a metal phobic component and a metal philic component that allows for the selective distribution of metal across the surface of the fiber is disclosed. The inventive multicomponent fibers may be used in fabrics and other products manufactured therefrom for economically imparting at least one of an antistatic quality, antimicrobial and antifungal efficacy, and ultraviolet and/or electromagnetic radiation shielding.

17 Claims, 4 Drawing Sheets

METAL-COATED FIBER

CROSS REFERENCE TO RELATED APPLICATIONS

This application claims priority to U.S. Provisional Patent Application No. 61/020,449, filed on Jan. 11, 2008, which is incorporated by reference herein in its entirety.

FIELD OF INVENTION

The present invention relates to multicomponent fibers having a metal coating. In particular, the present invention relates to multicomponent fibers with a metal coating that is selectively distributed across at least one fiber component.

BACKGROUND OF THE INVENTION

Metal-coated fibers are used in many different products. For example, silver coated, antimicrobial fibers are used in a variety of products in the medical industry because of its bactericidal capability, with proven efficacy against microbes, bacteria, and fungi, and its ability to eliminate odors. Silver coated fibers can be used in wound dressings, clothing for medical personnel, and other fabrics used in the clinical setting. Antimicrobial fibers find use in absorbent materials that contact the skin such as diapers, clothing, bedsheets, bedpads, blankets, and the like. Antimicrobial fibers may be formed with inorganic additives distributed to certain areas of the fiber. Because the antimicrobial agents are only effective when on or near the surface, it is typically desirable that these agents be dispersed throughout a thin coating that is applied to the surface of the fiber.

The antimicrobial characteristics of certain metal-coated fibers are also useful in water and air filtration applications, such as water purifiers and germ-removing filter having fibers bonded with silver ions for sterilizing air. These filters can also be used to filter air that has a substantial amount of recirculated air from confined spaces such as in vehicles and aircraft cabins. The filters are also useful in environments where a high degree of sterility is required such as in hospitals, clean rooms, and food processing and preparation areas. However, before such filters can achieve widespread adoption in many consumer applications, they must be economically priced.

Metal coatings can impart electrical conductivity to non-conductive fibers. The conductivity can be selectively controlled for a given application by varying the type and extent of metal coating applied to the fiber. Metal-coated fibers having a high degree of electrical conductivity have found uses in, for example, the medical industry for certain specific medical devices, fabrics that shield other materials from a dissipated static charge, conductive tapes, and filters as further disclosed herein.

Metal-coated fibers can be used in textiles for imparting antistatic performance. Static electricity can cause a spark discharge of a static electrical charge that has built up, typically as a result of friction, on the surface of a non-conductive material. Consumers prefer fabrics substantially free of static charges that can otherwise interfere with the comfort and enjoyment of the product. The antistatic quality of the fabric can also be important for clothing worn in certain applications such as for preventing static discharge when working with microelectronic equipment and when working in other clean room and clinical settings. The ability to resist static buildup can also make these fibers useful in flexible-shielded enclosures and other packaging materials particularly for storing and shipping sensitive electronics. Preferably, the fibers of these materials are designed to have a requisite type and amount of metal coating needed to impart a sufficient degree of electrical conductivity or low electrical resistivity that allows an electrical charge to dissipate without sparking. This design choice is guided by the proper balance between the cost and the effectiveness of the fabric.

Fibers with metal coatings are also useful for electromagnetic and radio frequency shielding. Electromagnetic and radio frequency shielding can be useful in the medical profession or other industries to prevent such waveforms from interfering with the operation of critical equipment sensitive to such waveforms. Furthermore, metal coated fibers are useful in certain military applications for preventing detection by infrared or radar systems. Certain applications, however, require that a controlled amount of metal coating be applied to the fiber. Also, waste results when more metal than an application requires is deposited on the surface of the fiber. Such waste can significantly increase the expense associated with manufacturing the product, particularly when the metal is a precious and/or expensive metal. This also serves to make the product less economically attractive and less available to the consuming public. One effort to resolve this problem has been to mechanically split a melt spun non-conductive nylon fiber into at least two filaments. One of the filaments is treated with a metal coating. The filaments are then recombined to obtain a yarn having a certain degree of electrical resistance and the needed support structure. However, it is difficult to precisely control the extent of material split into each filament and, as further disclosed herein, it can also be difficult to obtain a consistent distribution of metal on a fiber coated on a continuous processing line depending on the method used to coat the fiber. Therefore, it can be difficult to meet a desired specification for a finished product using the fiber formed by this technique.

Another approach to controlling the extent of activity of the coating applied to the fiber is to vary, for example, the concentration of the active component. However, such coatings can be difficult to formulate and any non-uniform distribution of coating across the surface of the fiber will inevitably cause the rate of antimicrobial activity to vary. U.S. Pat. No. 6,841,244 describes the difficulties involved in evenly dispersing throughout the fiber coatings that contain metals. As noted therein, the problem is exasperated because many of the metal-containing compounds in these coatings are quite large.

Conductive materials have previously been made by blending conductive fibers with other fibers in order to impart electrostatic dissipating capability to the finished fabric. The conductive fibers need to be blended with other fibers in order to control the color and texture of the finished fabric. The coated fibers tend to have a dark color that can lead to color variations, a stiffness that can impart undesirable tactile properties to the fabric, and an abrasive feel due to the conductive particles at the surface of the fiber. Thus, the properties of the blended fiber can be inconsistent across the material because of the problems cited above. Further, blending fibers to achieve the desired conductive properties increases the cost of the finished conductive material. There remains a need in the art for fibers that have a metal disposed only partially across the surface in order to overcome inconsistencies in color, tactile, and other physical properties that can occur in conventional blended fibers and to reduce the cost of materials made therefrom.

Masking processes may be used for selectively distributing a metal on the surface of a non-conducting fiber, and these types of processes generally involve applying a seed material containing a catalytic agent, which facilitates the subsequent electroless metal deposition on the surface of the fiber. This approach requires that the surface of the fiber be thoroughly cleaned before the seed material is applied. In order to achieve a consistent distribution of metal across the surface of the fiber, the seed material itself must be evenly distributed. Inasmuch, the conditions under which the process is carried out and the consistency and composition of the seed material must be tightly controlled in order to achieve a consistent distribution of metal across the surface of the fiber. Further, in order to achieve the desired conductive properties, the seed material must be consistently distributed across the full axial extent of the fiber, while limiting it to only a certain circumferential area, a process that can be difficult to achieve using conventional masking operations.

One attempt at making a fiber that is partially nonconductive and partially conductive includes disposing graphite or metal particles throughout a polymer, however, the conductive material is not disposed substantially at the surface of the component. Furthermore, the fiber does not address the cost barrier associated with disposing materials substantially circumferentially about the surface of the fiber particularly when an application requires the use of higher priced metals.

There remains in the art a need for a fiber whose surface can be selectively coated with a metal. Further, the art requires a fiber that is partially coated whereby the coating becomes substantially adhered to a receptive surface. Additionally, there remains in the art a need for a fiber whose surface can be selectively coated with a metal and yet provide the metal-coated fiber with other advantageous properties such as flame retardance and chemical resistance.

BRIEF SUMMARY OF THE INVENTION

The present invention relates to multicomponent fibers having a metal that has been selectively disposed on a metal philic surface of at least one fiber component. While not wishing to be bound by theory, the multicomponent fibers of the present invention are formulated to provide advantages that are comparable to those of other metal-fibers, but, at the same time, doing so in an efficient and cost effective manner.

In one aspect, the invention provides a multicomponent fiber having an outer surface. The outer surface is defined by at least one fiber component that is metal philic and at least one other fiber component that is metal phobic. In one embodiment, the metal philic fiber component defines from at least about 0.5% to at most about 49% of the total area of the outer surface of the multicomponent fiber, and the metal phobic fiber component defines the remaining area of the outer surface of the fiber. The metal philic fiber component comprises substantially more metal component than the metal phobic fiber component. In another embodiment of the invention, the metal phobic fiber component is substantially free of the metal component.

In another embodiment of the invention, the metal component is at least one of elemental metal; a salt comprising the metal; a metal oxide; a matrix particle comprising the metal; and a coating medium comprising at least one of elemental metal, salt comprising the metal, a metal oxide, and matrix particle comprising the metal. In one embodiment of the invention, the metal component is selected such that the multicomponent fiber is electrically conductive. In another embodiment of the invention, the metal component is selected such that the multicomponent fiber has an antimicrobial quality.

In certain embodiments of the invention, the metal component comprises a metal that is at least one of silver, nickel, gold, platinum, copper, aluminum, iron, iron compounds, palladium, tin, zinc, and any combination thereof. In yet another embodiment of the invention, the metal component comprises silver.

In an embodiment of the invention, the multicomponent fiber has a cross-section that is substantially pie-wedge shaped, substantially a side-by-side configuration, and any combination thereof.

In some embodiments of the invention, the material of the metal phobic fiber component comprises at least one of polyethylene terephthalate, polybutylene terephthalate, polytrimethylene terephthalate, polyphenylene sulfide, polyethylene, polypropylene, and copolymers thereof.

In certain embodiments of the invention, the metal philic fiber component is a polyamide compound including any combinations of nylon. In a preferred embodiment of the invention, the metal philic fiber component is nylon 6. Even more preferably, the metal philic fiber component is nylon 6 and the metal phobic fiber component is polyethylene terephthalate.

In another aspect, the invention provides a fabric comprising a multicomponent fiber of the invention. In an embodiment of the invention, the fabric is a woven fabric, a non-woven fabric, a knitted fabric, and any combination thereof.

In another aspect, the invention provides a product of manufacture comprising a multicomponent fiber of the invention. In an embodiment of the invention, the product of manufacture is an electrically conductive article of clothing.

BRIEF DESCRIPTION OF THE SEVERAL VIEWS OF THE DRAWINGS

Figure 1:
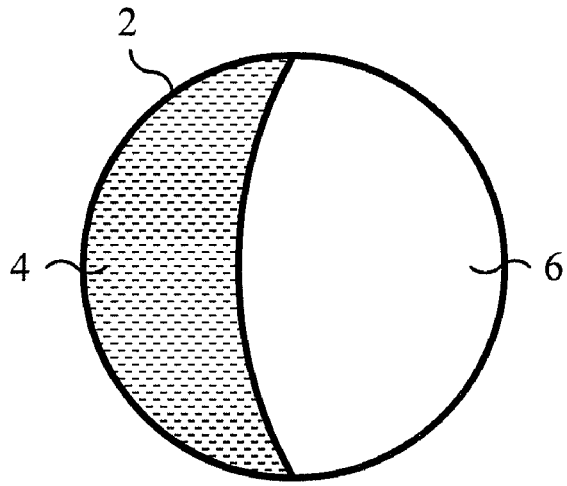
Figure 2:
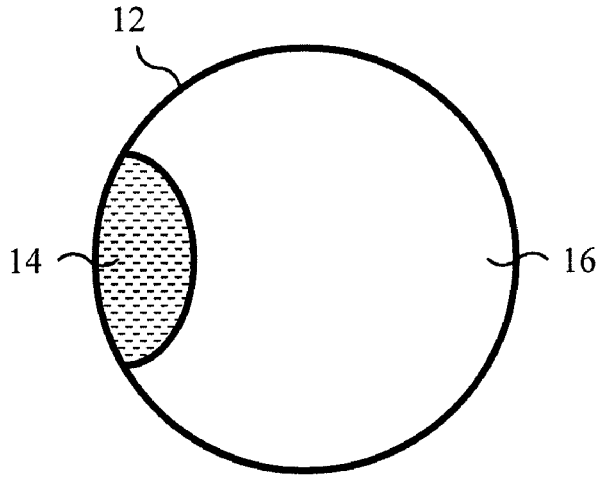
Figure 3:
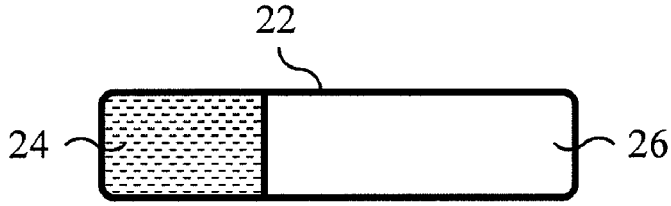
Figure 4:
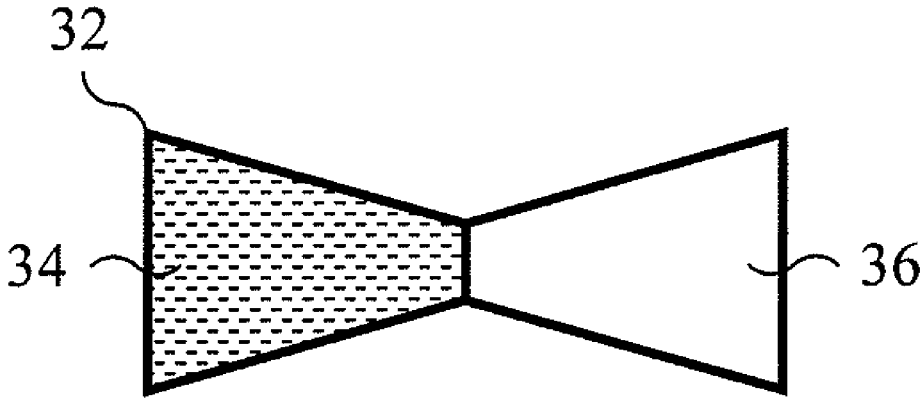
Figure 5:
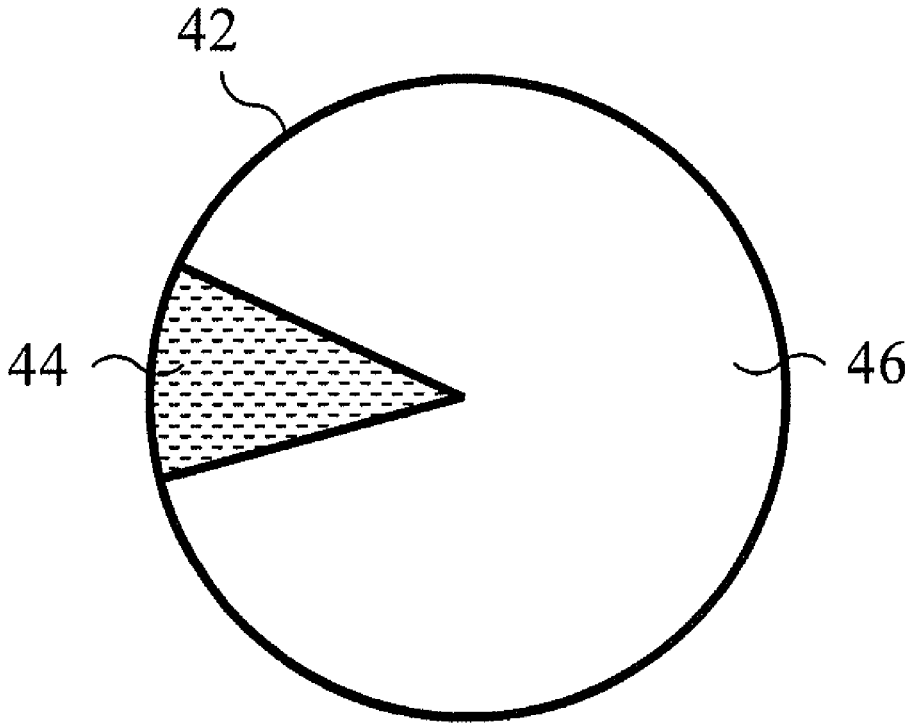
Figure 6:
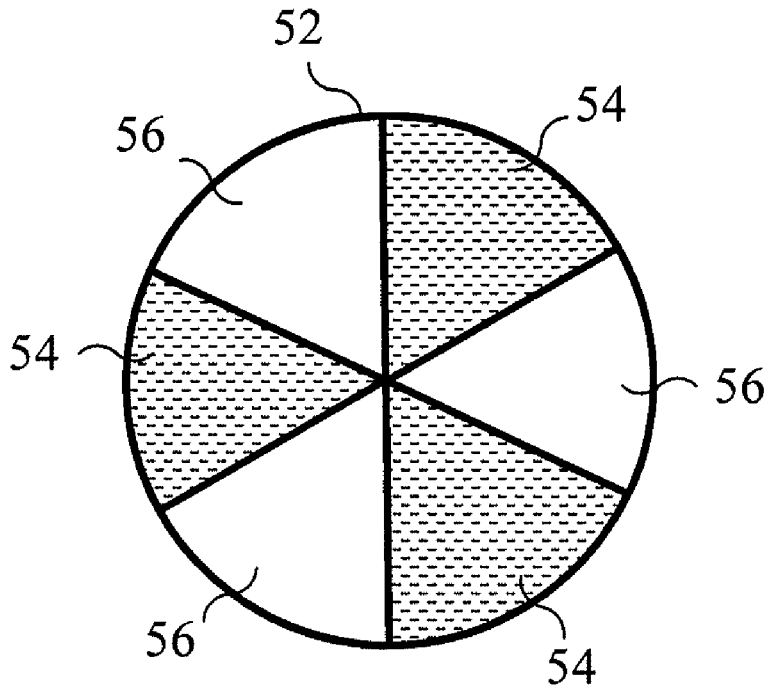
Figure 7:
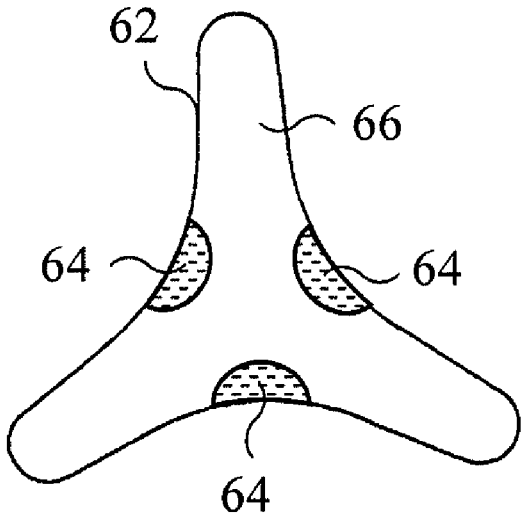
Figure 8:
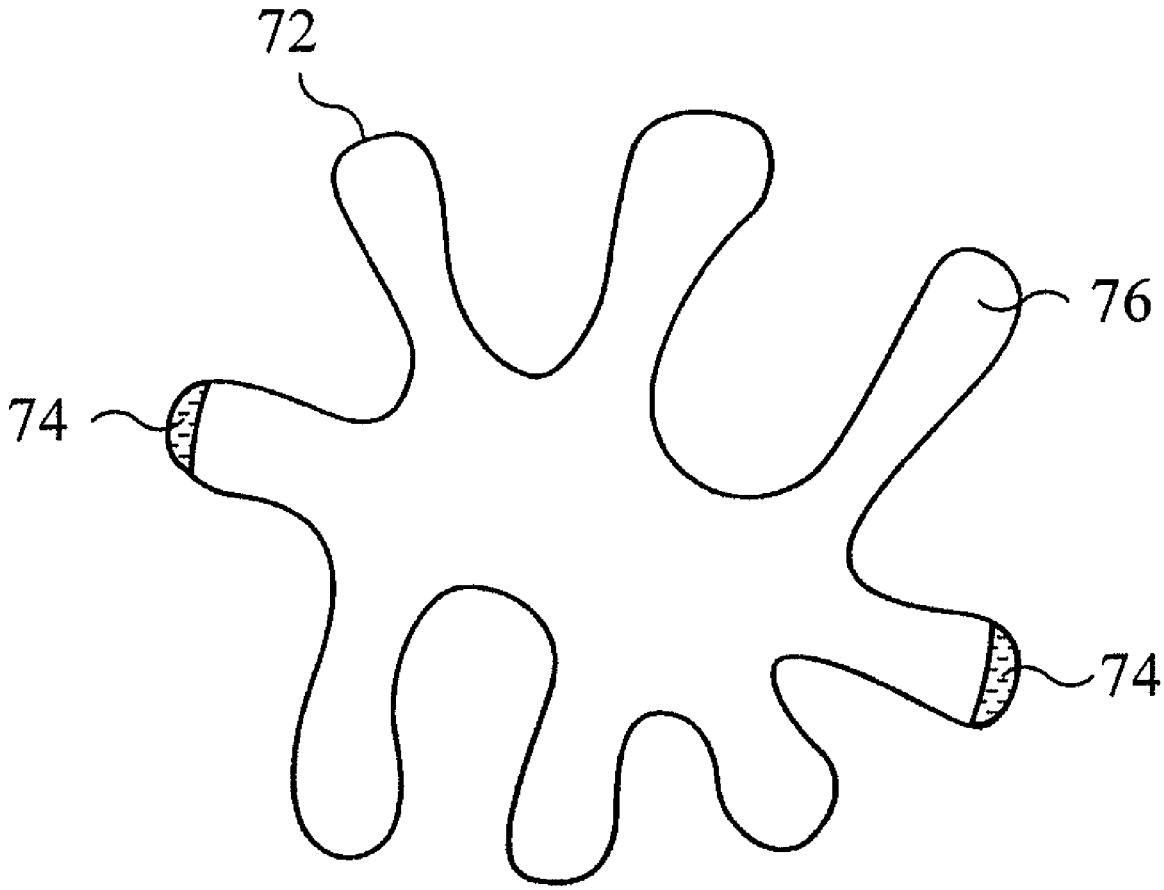

Having thus described the invention in general terms, reference will now be made to the accompanying drawings, which are not necessarily drawn to scale, and wherein:

FIG. 1 is a cross-section illustrating a multicomponent fiber according to one embodiment of the invention, wherein the fiber is substantially round and has a side-by-side configuration;

FIG. 2 is a cross-section illustrating a multicomponent fiber according to another embodiment of the invention, wherein the fiber is substantially round and has a side-by-side configuration;

FIG. 3 is a cross-section illustrating another embodiment of a side-by-side multicomponent fiber according to the invention, wherein the fiber has a ribbon shape;

FIG. 4 is a cross-section illustrating yet another embodiment of a side-by-side multicomponent fiber according to the invention, wherein the fiber has a bow-tie ribbon shape;

FIG. 5 is a cross-section illustrating a multicomponent fiber according to an embodiment of the invention, wherein the fiber is substantially round and has a pie-wedge shape;

FIG. 6 is a cross-section illustrating a multicomponent fiber according to another embodiment of the invention, wherein the fiber is substantially round and has a pie-wedge shape;

FIG. 7 is a cross-section illustrating a multicomponent fiber according to an embodiment of the invention, wherein the fiber is a trilobal fiber; and FIG. 8 is a cross-section illustrating a multicomponent fiber according to an embodiment of the invention, wherein the fiber is a capillary-grooved fiber.

DETAILED DESCRIPTION OF THE INVENTION

The present invention now will be described more fully hereinafter with reference to the accompanying drawings, in which some, but not all embodiments of the inventions are shown. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting the invention. Like numbers refer to like elements throughout.

Many modifications and other embodiments of the inventions set forth herein will come to mind to one skilled in the art to which these inventions pertain having the benefit of the teachings presented in the descriptions herein and the associated drawings. Therefore, it is to be understood that the inventions are not to be limited to the specific embodiments disclosed and that modifications and other embodiments are intended to be included within the scope of the appended claims.

As used in the specification and in the appended claims, the singular forms "a", "an", and "the" include plural referents unless the context clearly indicates otherwise. For example, reference to "a metal component" includes a plurality of such metal components.

It will be understood that relative terms, such as "radially" or "circumferentially" or "axial" or "longitudinal" or the like, may be used herein to describe one element's relationship to another element as illustrated in the Figures. It will be understood that relative terms are intended to encompass different orientations of the articles in addition to the orientation as illustrated in the Figures. It will be understood that such terms can be used to describe the relative positions of the element or elements of the invention and are not intended, unless the context clearly indicates otherwise, to be limiting.

Embodiments of the present invention are described herein with reference to various perspectives, including cross-sectional and perspective views that are schematic representations of idealized embodiments of the present invention. As a person having ordinary skill in the art to which this invention belongs would appreciate, variations from or modifications to the shapes as illustrated in the Figures are to be expected in practicing the invention. Such variations and/or modifications can be the result of manufacturing techniques, design considerations, and the like, and such variations are intended to be included herein within the scope of the present invention and as further set forth in the claims that follow. The articles of the present invention and their respective components illustrated in the Figures are not intended to illustrate the precise shape of the component of an article and are not intended to limit the scope of the present invention.

Although specific terms are employed herein, they are used in a generic and descriptive sense only and not for purposes of limitation. All terms, including technical and scientific terms, as used herein have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

The invention described herein relates to a multicomponent fiber comprising at least one fiber component that is metal philic and at least one fiber component that is metal phobic. As used herein, a metal philic component comprises a material that selectively imparts a certain degree of attraction substantially between the surface of the metal philic component and a metal-based material. A metal phobic component is intended to mean a material that is not metal philic. Accordingly, a metal phobic component can be neutral (i.e., exhibiting neither attraction nor repulsion) to a metal-based material or can exhibit a certain degree of repulsion substantially between the surface of the metal-phobic component and a metal-based material.

The invention provides improvements over conventional metal-coated fibers known in the art by reducing the cost of the fiber without substantially compromising the effectiveness of the metal in many applications where the fiber is intended to be used. The inventive fibers have reduced variation in distribution of the metal in fabrics made therefrom because the area that is coated is selectively contained to the surface of a metal philic fiber component and does not encompass the full circumferential area defining the fiber. However, the metal philic component and surface metal applied thereon extend substantially continuously longitudinally along the axial direction of the fiber. This feature of the inventive fiber allows for a metal to be strategically disposed such that it provides the greatest possible benefit, with less strategic portions of the fiber surface remaining substantially free of the metal. The inventive fibers and fabrics made therefrom opens markets to such fabrics that otherwise could not exist because of the cost-prohibitive nature of depositing metals substantially over the entire surface of the fiber by conventional coating techniques.

Metal fibers produced by mechanical splitting requires equipment to first split the spun filament, coat one of the split filaments, and then recombine the filaments to form the finished fiber. The susceptibility of the metal philic component to the metal-based coating reduces the need for coating systems that ensure the fiber is fully wetted to ensure an even coat. The inventive fiber overcomes many other coating problems, such as the ability to obtain an even distribution of coating across the surface of the fiber.

Further, the inventive fiber overcomes the need to blend metal-coated fibers with fibers that are substantially free of metal in order to provide, for example, a static-free fabric. Products, such as fabrics, made from the inventive fiber that would otherwise incorporate a metal coated fiber in a blend of fibers provide a more consistent distribution of metal throughout the product, improved color consistency, elimination of dark color points imparted by the fully coated metal fiber, superior tactile qualities, and improvements over other problems typically encountered with conventional fiber blends.

The inventive fibers substantially dispose the metal at the surface of the fiber as opposed to having the metal disposed within or below the surface of the fiber. As further disclosed herein, metals disposed substantially at the surface of a fiber are more effective for certain types of applications, such as, for example, metal-coated fibers for antimicrobial applications. Active agents, such as antimicrobial metals, disposed immediately below the surface of the fiber will not be immediately effective for their intended purpose.

Further, the inventive fibers overcome many of the technical and commercial difficulties associated with masking of fiber substrates to selectively impart a coating to only a portion of the surface of the fiber. Such processes involve multiple steps, have high capital costs, and can be expensive to operate. Further, it is difficult to apply the masking agent to only a select portion of a small fiber surface particularly as that fiber is rapidly spun through a continuous production line. The inventive multicomponent fiber, as described herein, overcomes these problems.

The term "metal philic" as used herein means to have an affinity for metal. In certain embodiments of the invention, a fiber component is metal philic if it has an affinity for the elemental metal itself. In other embodiments of the invention, a fiber component is metal philic if it has an affinity for salts comprising the metal. In other embodiments of the invention, a fiber component is metal philic if it has an affinity for a metal oxide comprising the metal. In yet other embodiments of the invention, a fiber component is metal philic if it has an affinity for a matrix particle comprising the metal. In still other embodiments of the invention, a fiber component is metal philic if it has an affinity for a coating solution wherein the metal is at least one of an elemental metal, a salt comprising the metal, a metal oxide, and a matrix particle comprising the metal is dispersed therein. In other embodiments of the invention, the fiber component is metal philic if it has an affinity for a precursor required in the metallization process. In an embodiment of the invention, the metal philic component has a substantial affinity for the metal. In other embodiments of the invention, the material of the metal philic component is selected, the surface of the metal philic component is conditioned, and any combination thereof, as further described herein, to impart a preferred affinity for the metal.

The term "metal phobic" as used herein means to lack an appreciable affinity for metal. In certain embodiments of the invention, a fiber component is metal phobic if it lacks an appreciable affinity for the elemental metal itself. In other embodiments of the invention, a fiber component is metal phobic if it lacks an appreciable affinity for salts comprising the metal. In other embodiments of the invention, a fiber component is metal phobic if it lacks an appreciable affinity for a metal oxide comprising the metal. In yet other embodiments of the invention, a fiber component is metal phobic if it lacks an appreciable affinity for a matrix particle comprising the metal. In still other embodiments of the invention, a fiber component is metal phobic if it lacks an appreciable affinity for a coating solution wherein the metal is at least one of an elemental metal, a salt comprising the metal, a metal oxide, and a matrix particle comprising the metal is dispersed therein. In other embodiments of the invention, the fiber component is metal phobic if it lacks an appreciable affinity for a precursor required in the metallization process. In one embodiment of the invention, the metal phobic component has an affinity for the metal that is less than the affinity of a metal philic component. In another embodiment of the invention, the metal phobic component substantially lacks any affinity for the metal. In other embodiments of the invention, the material of the metal phobic component is selected, the surface of the metal phobic component is conditioned, and any combination thereof, as further described herein, to impart a preferred affinity for the metal, or, optionally, substantially no affinity at all for the metal.

The term "affinity" as used herein means the ability of one material to become adhered to another material. For example, the one material can be an elemental metal, a salt comprising a metal, a metal oxide, a matrix particle comprising a metal, a coating solution wherein such a metal is dispersed, a precursor to a metallization operation, and any combination thereof. The other material can be a component of a multicomponent fiber. Preferably, the exposed surface of the component of a multicomponent fiber will be such that it has the desired affinity for the metal. "Adhere" or "adhered," as used herein, means to become bound, such as through, for example, frictional forces with intersticial pores in the fiber, or to form a bond such as through intermolecular bonds, intramolecular bonds, and combinations thereof.

Intermolecular bonds are bonds that form between molecules. An example of an intermolecular bond includes a hydrogen bond. Hydrogen bonds form between two highly polar molecules. The bond develops when the partially negative end a polar molecule aligns itself such that it faces a partially positive end of another polar molecule. Polarity arises in a molecule when, for example, hydrogen, which has a low electronegativity, covalently bonds with atoms having a higher electronegativity such as, for example, oxygen or nitrogen. A hydrogen bond can be formed when the metal philic component is a polymer that is polar. Also, the metal itself must be in a form that is polar. Examples of polar polymers include, but are not limited to, polyamides; polyacrylates such as poly(acrylic acid) and poly(methacrylic acid); polyesters such as aliphatic polyesters, for example polyactic acid, but less preferably aromatic polyesters; polyanhydrides; copolymers of polyolefins having one or more polar monomers such as acetates, anhydrides, esters, alcohol, and or acrylics; polycarbonate; polyoxides; polysulfides; polysulfones; polyurethanes; polyimides; copolymers thereof; and any combination thereof. Indeed, any homopolymer, copolymer, and terpolymer containing polar groups such as esters, ethers, ketones, amides, imides, alcohols, phenols, halides, acids, anhydrides, sulfides, nitrites, isocyanates, aromatic and heteroaromatic groups are sufficient to impart the requisite polarity to the metal philic component. The degree of affinity of such polymers can be controlled by varying the proportion of polar groups to that of the non-polar groups such as, for example, ethylene, propylene, and butylene. Non-limiting examples of such combinations include poly(vinyl acetate), poly(vinyl alcohol), poly(vinyl chloride), poly(vinyl pyridine), and poly(vinyl pyrrolidone). Preferably, the metal philic component is a polar polymer that is at least one of nylon 6; nylon 6,6; nylon 11; nylon 12; nylon 6,12; copolymers thereof; and any combination thereof. More preferably, the metal philic component is the polar polymer nylon 6.

Of course, to promote hydrogen bonding with the metal at the surface of a polar fiber component, the metal itself must be polar in nature. Non-limiting examples of such metal compounds capable of forming a hydrogen bond with a metal philic component include the polar metal compounds disclosed in U.S. Pat. No. 3,314,931 (organic compounds containing metals from groups I-IV of the Periodic Table combined with an alcohol, phenol, enol forming ketone, hydroxyether, mercaptan, mercaptoether, thiophenyl, or amine groups) and U.S. Pat. No. 2,150,349 (complex organic metal compounds), which are incorporated herein by reference in their entirety. Alternatively, the metal can be dispersed in a solvent with the solvent itself being a polar compound. Examples of polar solvents capable of providing good dispersion performance include, but are not limited to, propylene carbonate, dimethyl-sulfoxide, N-methyl-2-pyrrolidone, γ-butyrolactone, and cyclo-hexanone.

Non-polar polymers suitable for use in the metal phobic component include, but are not limited to, polyolefins, polystyrenes, and aromatic polyesters.

In certain embodiments of the invention the bonds can be intramolecular bonds. In these alternative embodiments, metals can become adhered to the surface of a fiber by first forming active sites at the surface of the fiber. An organometalic compound exposed to the prepared surface then chemically reacts with the active site to form an intramolecular bond, or a bond that holds atoms together. Exemplary processes for applying metals to thermoplastic substrates in this manner can be found in U.S. Pat. Nos. 4,869,930 and 6,506,293, which are incorporated herein by reference in their entirety.

In another embodiment of the invention, the metal can be adhered to the surface of the metal philic fiber component through intramolecular bonding by coating the fiber with a composition of at least one of a monomer and a prepolymer, initiator, catalyst to form a polymer, and a metal, as described herein, disposed substantially evenly throughout the composition. The composition reacts to form a polymer containing the metal, which defines the surface of the fiber. Of course, the components must be selected such that at least one, preferably more, has a greater affinity for the metal philic component than for the metal phobic component. In one embodiment of the invention, the catalyst is selected such that it preferentially becomes adhered to the metal philic fiber component. In this embodiment, the catalyst is first applied to the surface of the fiber by any of the methods as disclosed herein. The other components of the composition along with the metal are then be applied to the surface of the fiber by any of the methods as disclosed herein. Without intending to be bound by theory, the polymer is formed when these other components containing the metal are contacted with the catalyst that is preferentially adhered to the metal philic fiber component. The unreacted components can be removed by any method that is known in the art such as through, for example, drying, washing, and any combination thereof. Any material that is applied that ultimately leads to the formation of metal at the surface of the fiber is known herein as a "precursor," "precursor to a metallization operation," or the like as used interchangeably herein.

Covalent bonding, being stronger than hydrogen bonding, is preferred in certain applications. Specifically, covalently bonded metal is preferred in applications where the products made from the inventive fibers require some degree of durability. An application, for example, where durability is important includes clothing applications where the inventive metal coated fibers are intended to impart an antistatic quality to the article of clothing. Other applications where durability of the metal coating that is adhered to the fiber is important can include products for use in electromagnetic and radio frequency shielding.

In other embodiments, the metals can be encapsulated within microcapsules or tubules contained within the coating itself. In this embodiment the coating becomes adhered to the surface of the metal philic component preferably through intramolecular bonding either between the metal philic component itself and the coating or another agent that chemically adheres the metal philic component and coating. An example of surface coatings that encapsulate the metallic agent can be found in U.S. Pat. No. 5,049,382, which is incorporated herein by reference in its entirety.

The art is replete with metals and coatings that can be applied to the surface of fibers. The art describes various methods for adhering metals, metal compositions, and coatings to the surface of a fiber by frictional forces, intermolecular bonding, intramolecular bonding, and any combination thereof. Any such metal and/or coating as well as methods for adhering the metal component, coating, or precursor known in the art are intended to be part of this disclosure. Exemplary methods for metalizing materials are described in U.S. Pat. Nos. 6,726,964 and 3,967,010. Preferably, the metallization process will be one that results in an even coating that is substantially continuous across the metal philic component of the multicomponent fiber.

As used herein, a "fiber" is understood to encompass individual fibers, fibers formed in direct fabric forming processes such as spunbonding and melt-blowing, continuous filaments, filaments of discrete length, staple fibers, yarns, and combinations thereof. The fibers of the invention, as described herein, may be made in the form of tow bundles. The term "tow bundle," as used herein, means a continuously produced multifilament band having individual filament deniers. In certain embodiments of the invention, the individual filament deniers may be in the range of about 0.5 denier/filament up to about 30 denier/filament. In other embodiments, the total number of continuously produced filaments in the band are from at least about 100 to at most about 2,000,000. In certain embodiments, the total denier is in the range of about 100 up to about 2,000,000.

The inventive fiber is a multicomponent fiber having at least one fiber component that is metal philic and at least one fiber component that is metal phobic with each fiber component defining a part of the fiber's surface. A "multicomponent fiber," as used herein, means a fiber having more than one fiber component each in spatial relationship with one another. In certain embodiments of the invention, the multicomponent fiber is a "bicomponent fiber," which has two separate fiber components that are in spatial relationship with one another.

The at least one fiber component that is metal philic may be any material amenable to being coated with metal. Suitable metal philic fiber components generally include, but are not limited to, polyurethane, nylon, polyacrylonitrile or other acrylamides, polymeric composites, copolymers, and any combination thereof. Some polymeric materials will be preferred over others depending on the type of bonding desired between the metal philic fiber component and the metal composition as disclosed herein.

Specifically, non-limiting examples of polymeric materials that may be used as the metal philic fiber component in a multicomponent fiber according to the present invention include the following: nylon 6, nylon 6,6, nylon 12, polyaspartic acid, polyglutamic acid, polyacrylamide, polyacrylonitrile, esters of methacrylic acid and acrylic acid, polybisphenol A carbonate, polypropylene carbonate, polybutadiene, polyisoprene, polynorbonene, polycaprolactone, polyglycolide, polylactide, polyhydroxybutyrate, polyhydroxyvalerate, polyethylene adipate, polybutylene adipate, polypropylene succinate, polyethylene glycol, polybutylene glycol, polypropylene oxide, polyoxymethylene, polytetramethylene ether, polytetrahydrofuran, polyepichlorohydrin, ureaformaldehyde, melamine-formaldehyde, phenol formaldehyde, polyphenylene oxide, polyphenylene sulfide, polyether sulfone, polyphenylene ether sulfone, polydimethyl siloxane, polycarbomethyl silane, polyvinyl butyral, polyvinyl alcohol, esters and ethers of polyvinyl alcohol, polyvinyl acetate, polyvinyl chloride, polyvinyl pyrrolidone, polymethyl vinyl ether, polyethyl vinyl ether, polyvinyl methyl ketone, polyethylene-co-vinyl acetate, polyethylene-co-acrylic acid, polylauryllactam-block-polytetrahydrofuran, and combinations thereof.

In another embodiment of the invention, the metal philic fiber component is a polar polymer as described herein. Preferably, the metal philic fiber component includes nylon 6; nylon 6,6; nylon 12; nylon 6,12; and any other polyamide. More preferably, the metal philic fiber component is nylon 6. In certain embodiments of the invention, the metal philic fiber component may also contain an unlimited variety of functional additives as known and used in the art.

For some applications, the metal philic component and the metal phobic component are selected so that they are chemically compatible to prevent the two components from splitting apart in the end use. Those of ordinary skill in the art will understand the compatibility requirement and will also know how to select compatible polymers or how to make otherwise incompatible polymers compatible through the use of certain agents. Further, the multicomponent cross section can be designed such that any incompatibility between the metal philic component and the metal phobic component is overcome. In a non-limiting example, the cross section can be such that the fiber components become interlocked allowing the components to be physically bound. The two components can also be selected to facilitate process efficiencies such as relatively rapid curing and/or drying time. Further, the components can be selected to provide desirable properties in the resulting fiber, for example, high tensile strength and/or acid dyeability.

The metal phobic fiber component may be any material that is not amenable to being coated with metal. In other embodiments of the invention, materials that are only slightly amenable to being coated with a metal may be used for the metal phobic fiber component. In yet other embodiments of the invention, the metal phobic fiber component is less amenable to being coated with a metal component than the metal philic fiber component.

The degree of affinity a fiber component has for a particular metal, surface coating, or precursor can be measured based on the amount of the material distributed per unit surface area of the fiber or fiber component given in units of $g/cm^2$. In an embodiment of the invention, the affinity of the metal phobic fiber component relative to the metal philic fiber component is less than about 50%, about 40%, about 30%, about 20%, about 10%, about 5%, about 2%, about 1%, or about 0.1%. Indeed, in other embodiments of the invention, the metal phobic fiber has substantially no affinity for the metal, coating, or precursor.

The metal phobic component preferably includes a standard "fiber-forming polymer," a term broadly used herein to mean any polymer that is capable of forming a continuous filament or preferably, a continuous multifilament tow bundle having the preferred degree of affinity for the metal. A wide variety of synthetic fiber-forming polymers and copolymers may be used for the metal phobic fiber component. Non-limiting examples of such polymers include polyethylene terephthalate (PET); polybutylene terephthalate; polypropylene terephthalate, nylon 6; nylon 6,6; polyphenylene sulfide; polyethylene; polypropylene; polyacrylonitrile; polyetherimide; polymethylpentene; aromatic polyamides; and copolymers thereof. A presently preferred metal phobic fiber component is PET. Other classes of useful metal phobic polymers include modacrylic polymer compositions, aromatic polyesters, aromatic polyamides, and polybenzimidazoles.

In certain embodiments of the invention, in addition to its metal phobic property, the metal phobic component will be selected for at least one of physical characteristics and chemical characteristics based on the intended end use of the fiber. In other embodiments of the invention, in addition to its metal phobic property, the metal phobic component will be selected based on physical characteristics, chemical characteristics, cost of the component, and any combination thereof. The preferable material for the metal phobic fiber component will be, in most cases, a melt-spinnable thermoplastic polymer having characteristics desirable for the particular end use. Melt spinnable polymers are preferred because melt-spinning techniques are currently well-known in the art for preparing multicomponent fibers. This should not be considered limiting because other methods may become known that will provide other types of multicomponent fiber forming techniques. For certain end uses, fibers with high heat resistance, for example, for use in clothing that will be subject to wear and laundering, or gamma radiation resistance, for example in electromagnetic and radio frequency shielding, is necessary. The material for the metal phobic fiber component should be selected to satisfy any of these requirements.

Additionally, the material of the metal phobic fiber component may contain one or more functional additives according to the desired end properties of the fiber or fabrics made therefrom. For example, dyes, flame retardants, delusterants, uv stabilizers, additives that impart chemical resistance, and the like, may be added. Optionally, the components of the multicomponent fiber may be selected such that they impart similar types of properties.

In addition, more than one metal philic fiber component or more than one metal phobic fiber component may be used to make a multicomponent fiber having more than two components. When more than one metal philic fiber component or more than one metal phobic fiber component is present, the components may be arranged in a variety of conformations known to any skilled artisan having the benefit of this disclosure. The only limitation on the cross-section of the multicomponent fiber is that a metal philic component must be present somewhere at the periphery of the multicomponent fiber in order to accept the at least one of elemental metal; salt comprising a metal; a metal oxide, matrix particle comprising the metal; and a coating medium comprising at least one of elemental metal, salt comprising the metal, metal oxide, and matrix particle comprising the metal.

In another embodiment of the invention, the metal phobic fiber component is a non-polar polymer as described herein.

Optionally, the metal phobic fiber component may have a thin layer of coating applied before or substantially contemporaneously with the metallization step. Preferably, the coating will be a coating that at least one of renders the fiber component more metal phobic, provides strength to the multicomponent fiber, and imparts some other desirable property to the multicomponent fiber.

In an embodiment, the metal philic fiber component of a multicomponent fiber, according to the invention, comprises nylon 6. In another embodiment, the metal phobic fiber component of a multicopomponent fiber, according to the invention, comprises PET. In a preferred embodiment of the invention, the multicomponent fiber comprises nylon 6 and PET. In another preferred embodiment of the invention, the multicomponent fiber comprises nylon 6 and PET and is an asymmetric multicomponent fiber. In another preferred embodiment of the invention, the multicomponent fiber comprises nylon 6 and PET and is an asymmetric multicomponent fiber with a side-by-side cross-section.

In other embodiments of the invention, the preferred ratio of components of the fiber is determined by the cross-section, or more precisely, the perimeter of the multicomponent fiber's cross-section. In certain embodiments of the invention, the metal philic fiber component comprises from about 0.1% to about 85%, more preferably from about 0.5% to about 49%, of the total area of the outer surface of the multicomponent fiber with the remaining area of the outer surface of the multicomponent fiber comprising at least one fiber component that is metal phobic. In certain embodiments of the invention, the surface area ratio of the metal philic component to metal phobic component will be from about 1:1000 to about 5:1, preferably from about 1:100 to about 1:1, and more preferably from about 1:10 to about 1:1. In certain preferred embodiments of the invention, the metal phobic fiber component comprises about 50% to about 90%, more preferably from about 60% to about 80% of the total area of the outer surface of the multicomponent fiber with the remaining area of the outside surface of the multicomponent fiber comprising at least one other fiber component that is metal philic. In a preferred embodiment of the invention, the metal phobic fiber component comprises PET and is from about 50% to about 90%, more preferably from about 60% to about 80% of the total area of the outer surface of the multicomponent fiber with the remaining area of the outer surface of the multicomponent fiber comprising at least one other fiber component that is metal philic. In another preferred embodiment of the invention, the metal phobic fiber component comprises PET and is from about 50% to about 90%, more preferably from about 60% to about 80% of the total area of the outer surface of the multicomponent fiber with the balance of the surface of the multicomponent fiber comprising nylon 6.

In other embodiments of the invention, the multicomponent fiber further comprises a metal component coated on the outer surface of the fiber substantially only on the portion of the surface comprising the metal philic fiber component. In other embodiments of the invention, the fiber is provided without a metal coated on the outside surface of the multicomponent fiber.

Preferably, the multicomponent fiber of the invention comprises a nylon that is at most about 85% of the surface area of the fiber. In other embodiments of the invention, the multicomponent fiber of the invention comprises a nylon that is at least about 0.5% of the surface area of the fiber.

A variety of cross-sectional arrangements for the multicomponent fibers are possible. At least a portion of one metal philic component must be present at the periphery but, in other embodiments, another metal philic component may not be present at the periphery, depending on the desired use of the multicomponent fiber. Of course, metal philic components that are not in contact with the periphery or the fiber will generally not be affected by the metal coating process. The components may be arranged, for example, in a pie/wedge or side-by-side embodiment. The fiber may be substantially circular in cross-section or it may be non-circular. Examples of non-circular cross-sections include, but are not limited to, trilobal, bean, kidney, mushroom, peanut shaped, and combinations thereof. In certain embodiments of the invention, the fiber may be multilobal. Methods for making multicomponent fibers into these different shapes are known in the art and are not further discussed herein.

A great number of varying conformations for a multicomponent fiber of the invention are envisioned wherein the fiber has an asymmetric or imbalanced multicomponent cross-section. Some of these embodiments are further described below with reference to the various Figures included herein. Of course, the skilled artisan, with the benefit of the disclosure herein, may envision further conformations that are in accordance with the present invention. Such further conformations are fully encompassed herein.

In one particular embodiment of the invention, the multicomponent fiber is a side-by-side fiber. FIG. 1 illustrates a substantially round embodiment of a side-by-side fiber showing a cross-section of the fiber 2 formed of a first fiber component 4 and a second fiber component 6. Preferably, both fiber components extend substantially continuously along the axial length of the fiber 2. In this embodiment, one of the fiber components, for example the first fiber component 4, is a metal philic fiber component, and the other fiber component, the second fiber component 6, is a metal phobic fiber component.

Another embodiment of the side-by-side fiber of the invention is shown in FIG. 2. In this embodiment of the invention, the cross-section of the fiber 12 is still formed of a first fiber component 14 and a second fiber component 16. However, the amount of the first fiber component 14 in cross-section is less than the amount of the second fiber component 16 relative to the amounts of each of the polymer components shown in the embodiment according to FIG. 1.

A side-by-side fiber according to the invention can have a variety of cross-sectional geometries. For example, FIG. 3 illustrates another embodiment of a side-by-side fiber that is ribbon-shaped, or flattened, in cross-section. In this embodiment, the fiber 22 comprises a first fiber component 24 and a second fiber component 26 wherein one of the fiber components is selected to be metal philic and one of the fiber components is selected to be metal phobic. In non-limiting examples, the polymers can vary by type, additives, structure, or combinations thereof.

Side-by-side multicomponent fibers of the invention have other cross-sectional geometries as well. For example, the fiber can have a cross-section that is a circle, oval, triangle, rectangle, octagon, pentagon, trapezoid, or the like, as long as the fiber comprises at least two fiber components with at least one fiber component being metal philic and at least one fiber component being metal phobic. Side-by-side fibers used in the invention can even have cross-sectional shapes that are not common geometrical shapes. In a preferred embodiment, the fiber has a cross-section that resembles a bow-tie. This embodiment is shown in FIG. 4, where the fiber 32 comprises a first fiber component 34 and a second fiber component 36 wherein one of the fiber components is selected to be metal philic and one of the fiber components is selected to be metal phobic.

FIG. 5 shows an embodiment of the multicomponent fiber that has a pie-wedge shape. Again, in this embodiment of the invention, the multicomponent fiber 42 has a first fiber component 44 and a second fiber component 46 wherein one of the fiber components is selected to be metal philic and one of the fiber components is selected to be metal phobic. This embodiment of the invention can be useful particularly in circumstances when only a small amount of metal needs to be distributed across the fiber 42—i.e., when the first fiber component 44 is the metal philic component. Alternatively, this embodiment of the invention can be useful in those circumstances when a large amount of metal needs to be distributed across the fiber 42—i.e., when the second fiber component 46 is the metal philic component.

FIG. 6 shows another embodiment of the multicomponent fiber that has a pie-wedge shape. The multicomponent fiber 52 comprises three wedges having a first fiber component 54 and the remaining three wedges having a second fiber component 56 wherein one of the fiber components is selected to be metal philic and one of the fiber components is selected to be metal phobic. The cross-sectional area of the multicomponent fiber may be represented by substantially equal amounts of each of the fiber components, as represented in this illustration. Alternatively, the cross-sectional area of the multicomponent fiber may be represented by varying amounts of each of the fiber components achieved, for example, by varying the size of at least one of the wedges of the multicomponent fiber.

Having the benefit of the disclosure herein, other conformations of the multicomponent fiber cross-sections can be further envisioned. For example, FIG. 7 represents a trilobal fiber 62 having a first fiber component 64 distributed in three positions strategically about the periphery of the fiber. As can be envisioned by a person having skill in the art based upon this disclosure, the fiber 62 may have less than or more than three positions in the cross-section where the first fiber component 64 can be positioned. The remaining peripheral area of the fiber 62 is occupied by a second fiber component 66. The first fiber component 64 may be selected to be either the metal philic component or the metal phobic component depending upon the application where the fiber is to be finally used. Of course, the second fiber component 66 will selected to be the metal phobic component or the metal philic component apposite the selection made for the first fiber component 64.

Another embodiment of the invention is shown in FIG. 8, which represents a capillary-grooved fiber with a first fiber component 74 distributed in a plurality of positions about the periphery of the fiber 72. A second fiber component 76 occupies the remaining peripheral area of the fiber 72. As can be envisioned by a person having skill in the art based upon this disclosure, the fiber 72 may have any number of positions in the cross-section where the first fiber component 74 can be positioned. Further, the first fiber component 74 may be selected to be either the metal philic component or the metal phobic component depending upon the application where the fiber is to be finally used. Of course, the second fiber component 76 will selected to be the metal phobic component or the metal philic component apposite the selection made for the first fiber component 74.

A non-limiting example of a commercially available capillary-grooved fiber includes the 4DG™ fiber available from Fiber Innovation Technology of Johnson City, Tenn. The deep grooves of the 4DG fiber provide the fiber with a high surface area. Furthermore, the channels in the surface of a 4DG fiber promote capillary wicking. As a result, these fibers are exceptionally well-suited for moisture transport applications. Adaptations to the 4DG fiber, as disclosed herein, would allow the fiber to selectively dispose anywhere across its surface a metal suitable for any number of applications as further described herein.

The multicomponent fiber of this invention, made of at least one metal philic component and at least one metal phobic component, may be approximately circular in cross-section as described herein. In other embodiments of the invention, the multicomponent fiber described herein is a "random" multicomponent fiber. In other embodiments of the invention, a cross-section of the random multicomponent fiber may show alternating layers of a metal philic component and a metal phobic component. The layers may be oriented roughly laterally across the cross-section, e.g. side-by-side layering. In one embodiment of the invention, layers of nylon 6 polymer alternate in a random fashion throughout the fiber with layers of PET. The multicomponent fibers of the invention may generally have an average of two layers in a given cross-section, an average of three layers in a given cross-section, an average of four layers in a given cross-section, or more. The layers in a given cross-section may extend substantially continuously through the axial length of the fiber. In another embodiment of the invention, it is preferred that the layers extend discontinuously along the axial length of the fiber.

The multicomponent fibers of the present invention are further advantageous because they are not limited to the more conventional rounded fiber configurations. Rather, the multicomponent fibers can be formed into other useful shapes—e.g., the ribbon and bow-tie cross-sections described herein. Generally, any shape for a multicomponent fiber can be used as long as the fiber is comprised of at least one metal philic component and at least one metal phobic component as described herein. Non-limiting examples of multicomponent fibers of unconventional shapes that may be useful according to the present invention are described in U.S. Pat. Nos. 5,277,976; 5,057,368; and 5,069,970, which are all incorporated herein by reference in their entireties.

A multicomponent fiber according to the invention can be prepared using any fiber formation technique known or to be developed in the art. An exemplary method for producing a bicomponent fiber is a process that includes the use of a pair of extruders. The extruders separately extrude the two fiber components making up the bicomponent fiber. The first fiber component is fed into a first extruder from a first hopper, and the second fiber component is fed into a second extruder from a second hopper. The first fiber component and the second fiber component are fed from the extruders through respective conduits by a melt pump to a spinneret that produces a bicomponent fiber having the desired cross-section. A skilled artisan will appreciate that additional extruders and hoppers as needed may be added for producing either a bicomponent fiber having multiple core fibers or a multicomponent fiber having more than two components but using the same described process. In a typical exemplary process, spun molten filaments are quenched by air blowing in cooling cabinets. A liquid finish may optionally be applied to the fibers to aid in processing.

The fiber components are preferably matched to allow spinning of the components through a common capillary at substantially the same temperature without degrading one of the components. The invention, however, should not be viewed as limited to combinations of fiber components with substantially similar extrusion temperatures. Rather, the extent of the difference between extrusion temperatures only becomes limited when the extrusion temperature required for one of the fiber components exceeds the temperature at which thermal degradation of any of the fiber components occurs.

Extrusion processes and equipment, including spinnerets, for making multicomponent continuous filament fibers are well known and need not be described here in detail. Generally, a spinneret includes a housing containing a spin pack that includes a plurality of plates stacked one on top of the other with a pattern of openings arranged to create flow paths for directing fiber-forming components separately through the spinneret. The spinneret has openings or holes arranged in one or more rows. The polymers are combined in a spinneret hole. The spinneret is configured so that the extrudant has the desired fiber cross section (e.g., round, bow-tie, etc.). The spinneret openings form a downwardly extending curtain of filaments. Such a process and apparatus is described, for example, in U.S. Pat. No. 5,162,074, which is fully incorporated herein by reference.

Following extrusion through the die, the resulting thin fluid strands, or filaments, remain molten for some distance before they are solidified preferably by cooling in a surrounding fluid medium. The surrounding fluid medium can include, for example, chilled air that is circulated through the strands. Once solidified, the filaments are taken up on a godet or other take-up surface. For example, in a continuous filament process, the strands are taken up on godet rolls that draw down the thin fluid streams in proportion to the speed of the take-up godet.

Optionally, additives may be incorporated into at least one of the components prior to extruding into the multicomponent fiber. Such additives may include those as described herein and may even include the metal of the inventive fiber. An exemplary process for incorporating additives into a component of a multicomponent fiber is disclosed in U.S. Pat. No. 6,841,244, which is fully incorporated herein by reference.

In addition to the proper selection of fiber components, a component can be made more metal philic or more metal phobic by a surface treatment. In certain embodiments of the invention, surface treatment methods may be used to make a fiber component more metal philic. Surface treatment processes to render polymer surfaces more metal philic include, but are not limited to, chemical and/or solvent processing, ozonization, plasma treatment, UV irradiation processing, high-pressure electro-discharge treatment, corona discharge processing, and flame treatment. Furthermore, it is also possible to coat the surface of the polymer with a material that promotes the philic nature of the fiber. Examples of such treatment are disclosed in U.S. Pat. Nos. 7,294,673; 5,258,129; 5,683,610; 5,972,505; 6,359,079; 5,403,426; 5,094,670; 6,110,588; 5,800,758; 5,736,619; 4,744,906; 4,460,648; 4,001,367; and 4,347,203, all of which are incorporated by reference. Preferably, such treatments will work to increase the philic nature of the metal philic fiber component relatively more than the philic nature of the metal phobic fiber component.

In one embodiment of the invention, the multicomponent fiber size ranges from about 0.1 dTex to about 20,000 dTex, from about 0.7 dTex to about 100 dTex, and from about 1 dTex to about 30 dTex. In another embodiment of the invention, the multicomponent fiber is a cut staple fiber in lengths greater than about 0.01 cm, preferably from about 0.1 cm to about 25 cm, and more preferably from about 0.3 cm to about 18 cm. In yet another embodiment of the invention, the multicomponent fiber is a continuous filament. In yet even other embodiments of the invention, the multicomponent fiber is a tow fiber in the form of a tow bundle. In other embodiments of the invention, a yarn comprises the multicomponent fiber of the invention with such yarn being spun from bundles of filaments of the invention, staple fibers of the invention, and combinations thereof.

Another aspect of the invention provides fabrics made from the multicomponent fiber as described herein. Metals and metal coatings are commonly known in the art and may be selected based upon the type of application for which the inventive multicomponent fiber and products made therefrom are intended. In an embodiment, the fabric of the invention is a woven fabric, a nonwoven fabric, a knitted fabric, and any combination thereof.

In one embodiment of the invention, the multicomponent fiber comprises a metal coating, the metal coating imparting anti-microbial and/or anti-fungal properties to fabrics or other products made from the multicomponent fiber of the invention as disclosed herein. In an embodiment of the invention, the anti-microbial/anti-fungal agents are metals such as, for example, copper, zinc, tin, and silver. Preferably the metal is in the form of a zeolite of silver dispersed in a polyethylene, polyethylene terephthalate, or polybutylene terephthalate carrier. In another embodiment, the zeolite of silver could be added directly to the surface of the metal philic fiber component without an intermediate carrier. The total anti-microbial additive ranges from about 0.2 wt % to about 15.0 wt % of the multicomponent fiber depending on performance requirements. Preferably the anti-microbial additives are held in the metal philic fiber component in such a way that they are prevented from washing off over time allowing them to maintain their anti-microbial and/or anti-fungal effectiveness.

In other embodiments of the invention, the anti-microbial agents are inorganic compounds made from metals such as copper, tin, zinc, silver, and the like. Preferrably, the compound is a zeolite of silver, such as a nanoparticulate material, dispersed in a polymer premix such as, for example, polyethylene, polyethylene terephthalate, or polybutylene terephthalate before being added to the fiber. In certain embodiments of the invention, the total active ingredients range from about 0.1 wt % to about 20 wt % based on the weight of the overall fiber. In other embodiments of the invention, the nanoparticulate material can comprise at least one of silver, tin, copper, zinc, and any combination thereof.

In other embodiments, any of the metals of the present invention may be microencapsulated. In this embodiment, the material of the metal philic fiber component is selected or the surface of the metal philic fiber component is treated as disclosed herein such that it will have an affinity for the microcapsules containing the metal. Examples of technology around metal-containing microcapsules can be found, for example, in U.S. Pat. Nos. 5,049,382, 6,287,542, 6,399,103, and 4,971,885.

In accordance with certain aspects of the invention, the multicomponent fiber imparts an antistatic characteristic to a fabric made therefrom. The electrically conductive material may be any electrically conductive material known in the art. Exemplary materials include, but are not limited to, metals, such as silver, brass, nickel, and aluminum; and metal oxides, such as tin oxide and copper oxide. In an embodiment of the invention, a product of manufacture is an electrically conductive article of clothing produced from the multicomponent fibers having antistatic characteristics as described herein.

In certain embodiments, the inventive multicomponent fiber is treated with a polymerizable material that forms a conductive polymer. The polymerizable material becomes suffused within the metal philic component where it is polymerized, otherwise known as forming the polymer "in situ." The terms "suffuse," "suffusing," "suffusible," and variations thereof, as used interchangeably herein, means to spread over the surface of the fiber, in a fluid-like manner, embedding within the surface of the metal philic fiber component certain agents contained within a suffusion medium. In addition to the metals as disclosed herein, the material preferably suffused within the metal philic component may be comprised of carbon, for example, carbon black, graphite, and the like. In a preferred embodiment of the invention, the multicomponent fiber comprises a metal phobic fiber component having PET and a metal philic fiber component of nylon 6 with the metal philic fiber component becoming suffused with a coating of nylon polymer dissolved in formic acid having suspended particles that impart a conductive property to the suffused fiber. In another preferred embodiment of the invention, the suffusion coating of nylon polymer dissolved in formic acid comprises suspended carbon particles.

In accordance with certain aspects of the invention, a product according to the invention comprises a multicomponent fiber of the invention that enables radiation blocking. Non-limiting examples of radiation that can be blocked include wavelengths in the ultraviolet spectrum and other electromagnetic radiation. In certain embodiments of the invention, a metal is disposed onto a microparticulate material that is deposited on the surface of the metal philic component. More preferably, the metal is coated onto the surface of the metal philic fiber component by any metallization process as disclosed herein. Further, any metallization process known or to become known in the art may be used in applying the metal to the metal philic fiber component. The metal can include at least one of or in any combination silver, tin, gold, platinum, copper, cobalt, palladium, cadmium, nickel, titanium, zinc, or other metals. A layer of oxidized metals may be disposed on the microparticulate material; however, this may lead to a decrease in conductivity of the microparticulate, a property that may be desirable in certain embodiments of the invention.

The invention may be used to form a multicomponent fiber having a metal philic component coated with a metalized microparticulate material, including a substrate formed of a dielectric polymeric material. The dielectric polymeric material may be formed of a composite including a resin and a reinforcing fiber. The resin may be an epoxy resin, or a non-epoxy resin such as an acrylic resin. The reinforcing fiber may be a binder fiber as disclosed herein. In an embodiment of the invention, a layer of microparticulate material may be disposed substantially above the surface of the metal philic component to be coated.

In accordance with certain aspects of the invention, a product according to the invention comprises a multicomponent fiber of the invention that enables the purification of a fluid. In one embodiment, the inventive device is a porous medium constructed form the metal-coated multicomponent fibers of the invention. The metal is selected, as disclosed herein, such that any microbes or fungi within the fluid become neutralized. In one embodiment, the inventive device filters air. In another embodiment, the inventive device is used to filter water.

These aforementioned applications of the multicomponent fiber of the invention and inventive fabrics and products made therefrom are merely exemplary. Having the benefit of this disclosure, a skilled artisan will contemplate other applications where the inventive multicomponent fibers and fabrics and products made therefrom can be used. This disclosure intends to capture these other applications as well.

There are a variety of processes known in the art for depositing metal or coating metal compositions on the surface of a fiber. Thermal spray processes are characterized by the steps of first heating up the coating material and then accelerating the material towards the fiber using a heated gaseous medium. Examples of spray processes include, but are not limited to, thermal spraying processes such as plasma spraying either at elevated pressure, under ambient pressure, or in the presence of a vacuum (i.e., low pressure plasma spraying); arc metallization; and metalorganic chemical vapor deposition. Spraying and deposition processes are typically characterized by the temperature of the process and the velocity at which the coating is applied. These types of processes for coating a substrate are characterized by a layer of the material that is positioned substantially parallel to the surface of the metal philic fiber component. In certain embodiments, as disclosed herein, the surface of the fiber is treated to make it more metal philic. In these embodiments, the material becomes disposed at least one of over the surface and just below the surface of the treated metal philic fiber component.

An apparatus for depositing a layer of metallized microparticulate material, such as in the production of silverized fibers, can be used to embed the microparticulate material into a resin layer on a surface to be coated. In this embodiment, the metal philic fiber component has an affinity for the resin. The resin layer allows the microparticulate material to become adhered to the surface that is coated. Of course, any other compound capable of allowing a microparticulate to become adhered to a surface may be used. If the microparticulate is applied in such a way that it is embedded in the surface of the metal philic component, such as through suffusion coating, a resin or other type of compound is not necessarily required to hold the microparticulate in place though may be desired, in certain embodiments of the invention, to impart a greater degree of adhesion to the metal philic component.

In further embodiments of the invention, the metal also forms a layer over the disposed material with this layer positioned substantially parallel to the surface of the metal philic fiber component. In certain embodiments of the invention, the metal phobic fiber component will substantially resist being coated by the metal during the coating process. In other embodiments of the invention, the metal phobic fiber component will become coated with a lesser amount of metal per unit surface area than the metal philic fiber component. In certain embodiments, the applied metal resists becoming adhered to the surface of the metal phobic fiber component but merely rests on the surface of the metal phobic fiber component. In other embodiments of the invention, the applied metal becomes adhered to the metal phobic fiber component but with a force that is less than the force of the metal applied to the surface of the metal philic fiber component, otherwise referred to herein, though not intending to be limiting, as becoming "loosely adhered" to the metal phobic fiber component. In certain embodiments, another step in the process involves removing the either non-adhered metal or the loosely adhered metal from the surface of the metal phobic fiber component. An example of such a removal process involves subjecting the fiber to a blast of gaseous medium. In certain embodiments of the invention, the temperature of the gaseous medium may be controlled to achieve the most optimal removal of metal from the metal phobic fiber component while leaving the metal on the surface of the metal philic fiber component substantially in tact.

In other embodiments of the invention, the coated fiber is subjected to a bath whereby non-adhered or loosely adhered metal is washed away from the surface of the metal phobic fiber component but the applied metal remains substantially adhered to the metal philic fiber component. In other embodiments, the bath contains a solvent that allows the non-adhered or loosely adhered metal to be dissolved away from the surface of the metal phobic fiber component but remains substantially adhered to the metal philic fiber component. In other embodiments, the bath washes away and dissolves the metal either non-adhered or loosely adhered to the surface of the metal phobic fiber component.

Another process for disposing a metal or a metal complex, such as a metal particulate to the surface of a metal philic fiber component, is a suffusion coating process. The suffusion coating process may be integrated into the fiber manufacturing process or may be a separate process and can comprise application by a kiss roll, static slit tube, wetted felt, sprayer, and other known means for allowing the filament to be coated.

Any process for applying a coating to the surface of a fiber known in the art may be used to apply the metal compound to the multicomponent fibers of the invention. Other such processes include, but are not limited to, the pretreatment and bath immersion techniques using silver nitrate solutions disclosed in U.S. Pat. Nos. 4,247,595; 4,362,779; 6,726,964; 6,335,301; and 6,037,057.

All publications mentioned herein, including patents, patent applications, and journal articles are incorporated herein by reference in their entireties including the references cited therein, which are also incorporated herein by reference. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

It will be appreciated by those skilled in the art that changes could be made to the embodiments described herein without departing from the broad inventive concept thereof. Therefore, it is understood that this invention is not limited to the particular embodiments disclosed, but it is intended to cover modifications within the spirit and scope of the present invention as defined by the appended claims.

That which is claimed:

1. A multicomponent fiber having an outer surface and comprising a first fiber component that is metal philic and at least one further fiber component that is metal phobic, wherein the first fiber component comprises about 0.5% to about 85% of the total area of the outer surface of the fiber and the at least one further fiber component comprises the remaining area of the outer surface of the fiber, and wherein the fiber further comprises a metal component coated on the outer surface of the fiber substantially only on the portion of the surface comprising the first fiber component.

2. The multicomponent fiber of claim 1, wherein the first fiber component comprises about 0.5% to about 49% of the total area of the outer surface of the fiber.

3. The multicomponent fiber of claim 1, wherein the metal component is selected from the group consisting of elemental metal; a salt comprising the metal; a metal oxide; a matrix particle comprising the metal; a coating medium comprising at least one of elemental metal, salt comprising the metal, a metal oxide, and matrix particle comprising the metal; a precursor to a metallization operation; and combinations thereof.

4. The multicomponent fiber of claim 1, wherein the metal component is any electrically conductive metal.

5. The multicomponent fiber of claim 1, wherein the metal component is any antimicrobial metal.

6. The multicomponent fiber of claim 1 the metal component comprises a metal selected from the group consisting of silver, nickel, gold, platinum, copper, aluminum, iron, iron compounds, palladium, tin, zinc, and any combination thereof.

7. The multicomponent fiber of claim 6, wherein the metal component comprises silver.

8. The multicomponent fiber of claim 1, wherein the multicomponent fiber has a cross-section selected from the group consisting of pie-wedge, side-by-side, and combinations thereof.

9. The multicomponent fiber of claim 1, wherein the at least one further fiber component comprises a polyester.

10. The multicomponent fiber of claim 1, wherein the at least one further fiber component is selected from the group consisting of polyethylene terephthalate, polybutylene terephthalate, polytrimethylene terephthalate, polyphenylene sulfide, polyethylene, polypropylene, copolymers thereof, and combinations thereof.

11. The multicomponent fiber of claim 1, wherein the first fiber component comprises a polyamide.

12. The multicomponent fiber of claim 1, wherein the first fiber component is nylon 6.

13. The multicomponent fiber of claim 10, wherein the at least one further fiber component is polyethylene terephthalate.

14. A fabric comprising the multicomponent fiber of claim 1.

15. The fabric of claim 14, wherein the fabric is selected from the group consisting of a woven fabric, a nonwoven fabric, a knitted fabric, and any combination thereof.

16. A product of manufacture comprising the multicomponent fiber of claim 1.

17. The product of manufacture of claim 16 comprising an electrically conductive article of clothing.

* * * * *